United States Patent [19]

Alley

[11] 4,245,488

[45] Jan. 20, 1981

[54] USE OF MOTOR POWER CONTROL CIRCUIT LOSSES IN A CLOTHES WASHING MACHINE

[75] Inventor: Robert P. Alley, Manlius, N.Y.

[73] Assignee: General Electric Company, Louisville, Ky.

[21] Appl. No.: 109,584

[22] Filed: Jan. 4, 1980

[51] Int. Cl.[3] ..... D06F 39/04

[52] U.S. Cl. ..... 68/12 R; 68/15; 68/184; 134/108; 310/64

[58] Field of Search ..... 68/15, 16, 184, 207, 68/12 R; 134/105, 107, 108; 137/340; 310/60 R, 62, 63, 64, 65, 87

[56] References Cited

U.S. PATENT DOCUMENTS

| | | | |
|---|---|---|---|
| 1,816,033 | 7/1931 | Wilsey | 68/15 |
| 2,995,917 | 8/1961 | Altorfer | 68/15 |
| 3,015,944 | 1/1962 | Krause | 68/12 R |
| 3,130,737 | 4/1964 | Jellies | 134/57 D |
| 3,152,462 | 10/1964 | Elliott et al. | 68/12 R |
| 3,152,463 | 10/1964 | Sones et al. | 68/12 R |
| 3,369,381 | 2/1968 | Crane et al. | 68/12 R |
| 3,503,228 | 3/1970 | Lake | 68/12 R |
| 3,608,337 | 9/1971 | Redfearn et al. | 68/12 R |
| 3,617,839 | 11/1971 | Hill | 318/806 |
| 3,739,145 | 6/1973 | Woehler | 68/15 X |
| 3,744,120 | 7/1973 | Burgess et al. | 228/198 |
| 3,766,634 | 10/1973 | Babcock et al. | 228/188 |
| 3,918,479 | 11/1975 | Perl | 137/340 |

FOREIGN PATENT DOCUMENTS

| | | | |
|---|---|---|---|
| 1406155 | 9/1975 | United Kingdom | 134/108 |

*Primary Examiner*—Philip R. Coe
*Attorney, Agent, or Firm*—Radford M. Reams

[57] ABSTRACT

In a direct drive clothes washing or cleaning machine, motor power control circuit losses in the form of heat, particularly from power switching semiconductors, are advantageously employed for additional heating of the wash water, thus simplifying the necessary heat sinking of the semiconductor elements as well as utilizing otherwise wasted heat. In one embodiment, a metallic plate like element, for example aluminum, has one side in contact with wash water. Heat-producing circuit components are mounted to the other side of the plate like element, preferably employing direct bonding techniques wherein metallic conductors are direct bonded to a non-metallic layer of high thermal conductivity and high electrical resistivity, for example alumina ($Al_2O_3$) or beryllia ($B_eO$). Semiconductor bodies are bonded to the metallic conductors, and the non-metallic layer is bonded to the plate like element.

11 Claims, 4 Drawing Figures

USE OF MOTOR POWER CONTROL CIRCUIT LOSSES IN A CLOTHES WASHING MACHINE

BACKGROUND OF THE INVENTION

The present invention relates generally to a clothes washing machine having an electronically controlled motor and, more particularly, to such a machine for advantageously utilizing heat resulting from motor control circuit losses, which would otherwise be wasted energy.

There have been a number of proposals to eliminate the mechanical transmission conventional in clothes washing machines for converting relatively high speed unidirectional motor rotation to low speed oscillatory (reversing) motion for agitation. These proposals envision coupling of a reversible, speed controllable DC motor either directly or through simple reduction gearing to the washing machine agitator. Through suitable control of the motor winding energization, desired agitator motion can be effected.

A number of suitable DC motor control circuits have been proposed employing various forms of semiconductor switching elements for effecting the desired control of motor rotational velocity and direction. By way of example, without in any way intending to limit the scope of the invention, such semiconductor switching elements include power bi-polar transistors, power field effect transistors, silicon controlled rectifiers (SCR's), triacs, and other forms of thyristors. Additionally, many such circuits employ free-wheeling diodes. Examples of such circuits may be found in the following U.S. Patents: Elliott et al U.S. Pat. No. 3,152,462; Sones et al U.S. Pat. No. 3,152,463; Crane et al U.S. Pat. No. 3,369,381; and Lake U.S. Pat. No. 3,503,228. Further examples may be found in the following commonly-assigned U.S. patent applications: Ser. No. 109,587 filed Jan. 4, 1980, by Robert P. Alley Ser. No. 109,579, filed Jan. 4, 1980, by Robert P. Alley and Richard C. Weischedel; and Ser. No. 109,705, filed Jan. 4, 1980, by John F. Park.

In such circuits, the semiconductor motor control elements are generally operated in a high efficiency switching mode such that minimal losses occur in the semiconductor switching elements. However, due to the substantial power switching requirements to control up to a horsepower DC motor with directional reversals more than once per second, substantial circuit losses, particularly in the switching transistors, nevertheless occur. These circuit losses are in the order of 25 to 70 watts.

As is known, such heating of power semiconductors results in a temperature rise which would rapidly destroy the semiconductors if not somehow dissipated. For this reason, heat sinks are conventionally provided for power semiconductors to carry away this excess heat.

SUMMARY OF THE INVENTION

Accordingly, it is an object of the invention to utilize this otherwise wasted heat resulting from losses in semiconductor switching elements, as well as other circuit losses, associated with motor power control circuits in clothes washing machines.

Briefly stated, and in accordance with a general concept of the invention, it is recognized that such circuit losses can perform the useful function of heating the wash water. Not only is the heat thus put to an advantageous use, but the problem of heat sinking the semiconductor heating elements is lessened. Even with wash water at a temperature which would be termed "hot", the semiconductor junctions may be operated at an even higher temperature, thus permitting the flow of heat from the semiconductor elements, as well as other circuit components, to the wash water. For example, the wash water may have a temperature as high as 60° C., and the semiconductor elements may have a temperature as high as 70° C.

It should be noted that the invention is not intended as a substitute for warm or hot incoming wash water, but rather provides auxiliary warming of the wash water which, at least, keeps the water from cooling as fast as it would otherwise during a wash cycle.

Briefly stated, and in accordance with a more particular aspect of the invention, a laundry machine for washing or cleaning clothes and the like using liquid, for example, water or other suitable fluid, includes an agitator, and an electric motor for driving the agitator. The laundry machine additionally includes motor power control circuitry having semiconductor devices for controlling energization of the motor, the circuitry generating heat as a result of circuit losses. In particular accordance with the invention, the laundry machine includes heat transfer structure for transferring heat generated by the circuitry to the washing liquid.

In one form, the laundry machine includes a pump for recirculating washing liquid, and the heat transfer structure comprises a semiconductor heat sink included as an element of the pump. More particularly, the heat transfer structure is in the form of a metallic plate-like element, one side of which is in contact with the washing liquid.

Preferably, the metallic plate-like element is aluminum, and carries a non-metallic layer of high thermal conductivity and high electrical resistivity, for example, alumina ($Al_2O_3$) or beryllia ($B_eO$), and metallic conductors, for example, copper, are direct bonded to the non-metallic layer. The semiconductor devices are in turn direct bonded to the copper or metallic conductors. These bonding techniques are more fully described in the commonly-assigned Burgess et al U.S. Pat. No. 3,744,120 and the commonly-assigned Babcock et al U.S. Pat. No. 3,766,634, the entire disclosures of which are hereby incorporated by reference.

In one form of the invention, the heat transfer structure forms a base plate for a self-contained module including the motor power control circuitry, all being of fairly compact configuration.

BRIEF DESCRIPTION OF THE DRAWINGS

While the novel features of the invention are set forth with particularity in the appended claims, the invention, both as to organization and content, will be better understood and appreciated, from the following detailed description taken in conjunction with the drawings in which:

DETAILED DESCRIPTION OF THE PREFERRED EMBODIMENT

Figure 1:
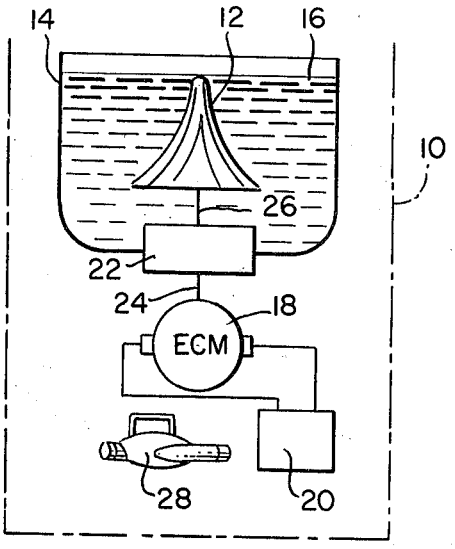
FIG. 1 is a highly schematic representation of a direct drive clothes washing machine.

Referring now to the drawings, wherein identical reference numerals denote similar or corresponding elements throughout the various view, FIG. 1 is a highly schematic representation of a clothes washing machine 10 having a conventional agitator 12 and a tub 14 containing wash water 16 and driven by a bi-directional electronically commutated motor (ECM) 18 capable of producing relatively slow oscillation of the agitator 12 during a wash cycle, and relatively high speed unidirectional spinning of the agitator 12 and tub 14 during a spinout cycle. Both types of motions are implemented by means of appropriate control of the voltage and current applied to the windings of the motor 18 by an electronic motor power control circuit generally designated 20.

Also seen in FIG. 1 is a connection mechanism 22 comprising a shifting device and a relatively simple reduction gearing mechanical transmission. The connection mechanism 22 has an input shaft 24 driven by the motor 18, an output shaft 26 for driving the agitator 12, and a connection to the tub 14. The connection mechanism 22 is operable in an agitate mode to transmit oscillatory motion of the input shaft 24 to the output shaft 26 to effect agitation and the laundering of clothes within the tub 14. In a spinout mode, the connection mechanism 22 is operable to transmit unidirectional rotation of the input shaft 24 to effect conjoint unidirectional rotation of the agitator 12 and the tub 14. A detailed description of a suitable connection mechanism 22 may be found in the commonly-assigned Erdman application Ser. No. 077,656, filed Sept. 21, 1979.

The particular clothes washing machine 10 illustrated in FIG. 1 additionally includes a motor driven pump 28 for recirculating the wash water 16, for example, to provide continuous filtering of the wash water 16 for removing lint and the like by means of a filter and recirculating path which are not shown, or to operate an additive dispensing system (not shown).

Figure 2:
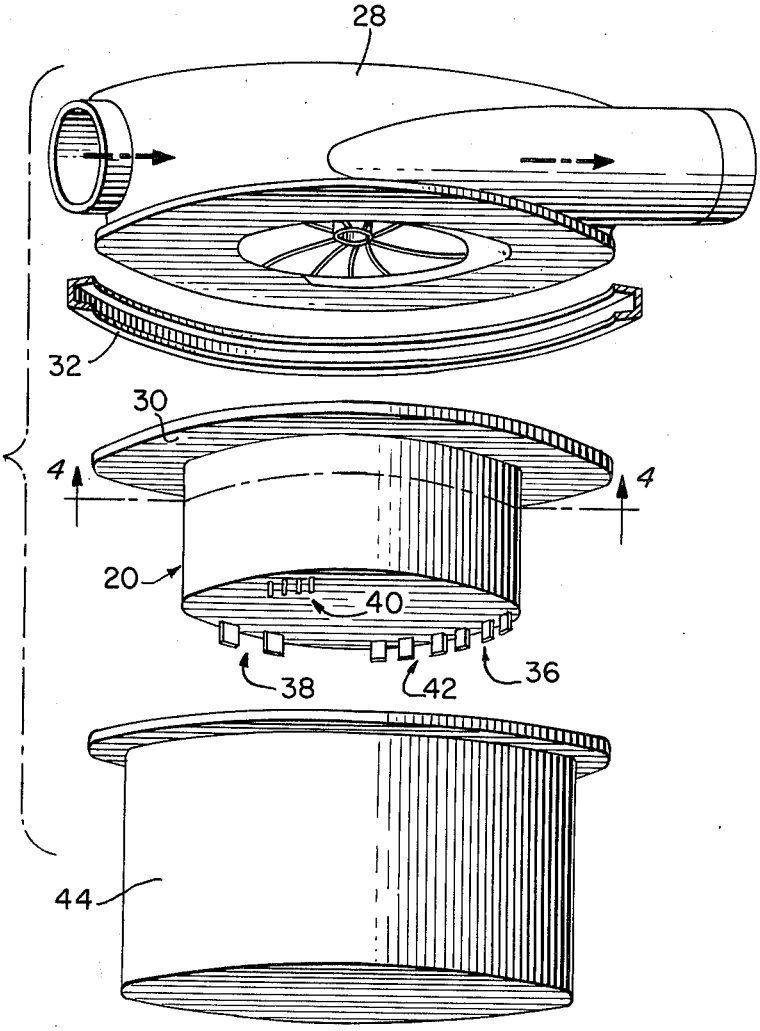
FIG. 2 is an exploded perspective view of the manner in which the circuitry-containing module of the FIG. 1 washing machine may be arranged in heat transfer relationship with water in a recirculating pump.

With reference now to FIG. 2, it will be seen that the circuitry 20 of FIG. 1 comprises a self contained module 20 mounted in heat transfer relationship with the pump 28, more particularly, in heat transfer relationship with the wash water 16 recirculated therethrough.

The module 20 comprises a disc-like aluminum base plate 30 secured to the underside of the pump 28 by means of a flange 32 of channel configuration, with the base plate 30 forming an element of the pump 28 having the top side thereof (in the FIG. 2 orientation) in direct contact with the wash water 16 which, it will be understood, circulates through the pump 28.

The module 20 additionally includes an outer housing 44, with a number of electrical connection terminals 36 extending from the bottom thereof and connected to circuitry therewithin. By way of example, a pair of terminals 38 serve to input 120 volt AC power supplied from a conventional household branch circuit, four terminals 40 serve to receive input control commands concerning desired rotational velocity and direction of the motor 18, and six terminals 42 are for connection to the windings (not shown) of the motor 18.

An outer housing or drip shield 44 completes the FIG. 2 assembly, so as to protect the power control module 20 and the electrical connections thereto from water.

No particular electrical control circuitry for the motor 18 is described in detail herein, as the present invention is not concerned with circuit details. Rather, in accordance with the present invention it is assumed that the power control circuitry within the module 20 contains various semiconductor control devices, perferably operated in a switching mode, to effect the required motions of the motor 18, as described hereinabove. By way of example, such power control circuits are described in the following commonly-assigned U.S. patent applications: Ser. No. 109,587, filed Jan. 4, 1989, by Robert P. Alley; Ser. No. 109,579, filed Jan. 4, 1980, by Robert P. Alley and Richard C. Weischedel; Ser. No. 109,705, filed Jan. 4, 1980, by John F. Park; and Ser. No. 077,656, filed Sept. 21, 1979, by David M. Erdman.

Figure 3:
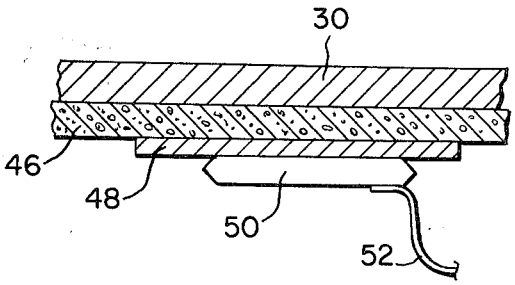
FIG. 3 is a cross-sectional view showing direct bonding techniques preferred in the practice of the invention; and, FIG. 4 is a bottom sectional view, taken along line 4—4 of FIG. 2, showing semiconductor bodies, copper conductors and alumina sheet elements mounted to the heat sinking base plate.

In FIG. 3, a cross-sectional view shows the preferred technique for mounting heat generating semiconductor switching elements comprising circuitry within the module 20 to the aluminum base plate 30. More particularly, the aluminum base plate 30 carries a non-metallic layer 46 of high thermal conductivity and high electrical resistivity, such as alumina ($Al_2O_3$) or beryllia ($B_eO$). A metallic conductor 48, for example, copper, is direct bonded to the non-metallic layer 46, and a representative semiconductor body 50 comprising a controlled switching element is in turn direct bonded to the copper or metallic layer 48. The direct bonding techniques employed may be those disclosed in the above-referenced commonly-assigned Burgess et al U.S. Pat. No. 3,744,120, and Babcock et al U.S. Pat. No. 3,766,634.

To complete the FIG. 3 representative structure, a representative lead 52 is bonded to the semiconductor body 50 using conventional fabrication technqiues.

It will be understood that the non-metallic layer 46 comprises a sheet of limited extent suitably bonded to the base plate 30, preferably after the semiconductor body 50 and the metallic conductor 48 are bonded to the non-metallic layer 46. This subsequent bonding of the non-metallic layer 46 to the base plate 30 may be accomplished using a high temperature epoxy, or by providing metallization on the layer 46 and soldering to the base plate 30.

While the particular embodiment illustrated is one which is presently preferred, it will be appreciated that other techniques for providing circuitry in heat transfer relationship with a metallic plate may be employed. One example is an enamel on steel circuit board with printed copper conductors on one side, and the other side in contact with the wash water. It will further be appreciated that the side of the base plate 30 in contact with the water may be either bare or coated with an electrically insulating layer of the same material as the layer 46. This is an especially likely configuration in the case of an enamel on steel circuit board.

Figure 4:
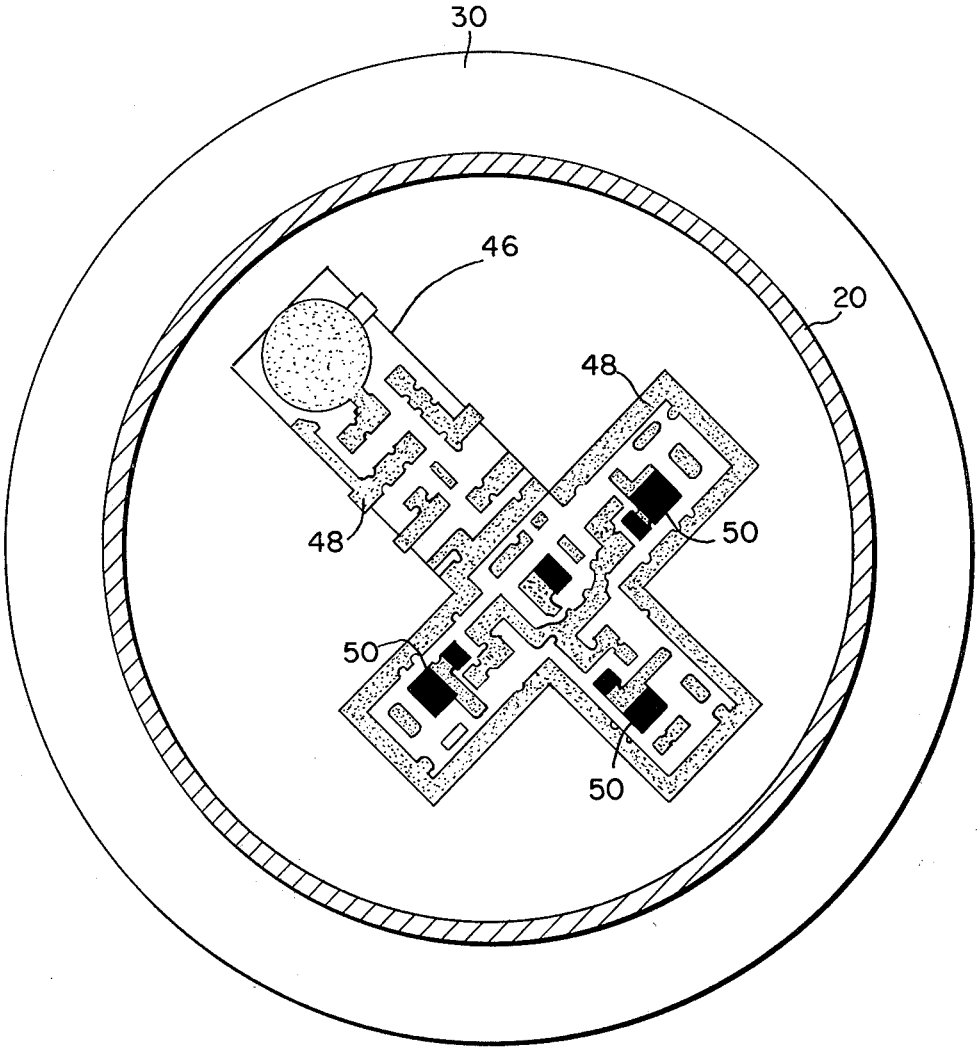

With reference now to FIG. 4, there is shown a representation of the manner in which power switching components of a representative circuit layout are mounted to the underside of the base plate 30 and, more particularly, to the alumina 46 layer thereof.

In FIG. 4, conductive circuit pads in the form of copper elements 48 bonded to the sheet elements of alumina layer 46 as described above with reference to FIG. 3 comprise printed wiring conductors in accordance with the particular power control circuitry selected. As is mentioned above, the precise circuit details comprise no part of the present invention. Accordingly, the particular layout shown for the copper conductors 48 is representative only.

Bonded at preselected locations to the copper conductors 48 are representative semiconductor bodies 50 comprising semiconductor switching elements such as power switching transistors or power field effect transistors, or power diodes. Accordingly, it will be appreciated that during operation of the transistors, the heat dissipated therein is efficiently transmitted through the copper 48 and the layer 46 to the alumunium base plate 30, and then to the wash water being recirculated by the pump 28.

In addition to the semiconductor components such as the bodies 50, it will be appreciated that other circuit components also generate heat to some extent, and this heat is likewise conducted through the plate 30 to the water.

Accordingly, it will be appreciated that the present invention provides efficient and synergistic use of otherwise wasted heat generated by the control circuitry in a direct drive clothes wash machine. Not only is the necessary heat sinking for the semiconductor elements simplified, but advantageous heating of the wash water results, for more effective washing operation.

While specific embodiments of the invention have been illustrated and described herein, it is realized that numerous modifications and changes will occur to those skilled in the art. It is, therefore, to be understood that the appended claims are intended to cover all such modifications and changes as fall within the true spirit and scope of the invention.

What is claimed is:

1. A laundry machine for cleaning clothes and the like using liquid, said machine comprising:

an agitator;

an electric motor for driving said agitator;

motor power control circuitry including semiconductor devices for controlling energization of said motor, said circuitry generating heat as a result of circuit losses; and heat transfer structure for transferring heat generated by said circuitry to the washing liquid.

2. A laundry machine according to claim 1, which further comprises a pump for recirculating washing liquid, and wherein said heat transfer structure comprises a semiconductor heat sink included as an element of said pump.

3. A laundry machine according to claim 2, wherein said heat transfer structure comprises a metallic plate-like element, one side of which is in contact with washing liquid.

4. A laundry machine according to claim 3, wherein the other side of said metallic plate-like element carries a non-metallic layer of high thermal conductivity and high electrical resistivity, and wherein metallic conductors are direct bonded to said non-metallic layer, with said semiconductor devices in turn direct bonded to said metallic conductors.

5. A laundry machine according to claim 4, wherein said metallic plate is aluminum, and said non-metallic layer of high thermal conductivity and high electrical resistivity is alumina.

6. A laundry machine according to claim 5, wherein said metallic conductors are copper.

7. A laundry machine according to claim 4, wherein said metallic plate is aluminum, and said non-metallic layer of high thermal conductivity and high electrical resistivity is beryllia.

8. A laundry machine according to claim 7, wherein said metallic conductors are copper.

9. A laundry machine according to claim 1, wherein said semiconductor devices are direct bonded to metallic conductors in turn direct bonded to a non-metallic layer of high thermal conductivity and high electrical resistivity carried on a metal sheet, the other side of said metal sheet being in contact with washing liquid.

10. A laundry machine according to claim 9, wherein said metallic conductors are copper, said non-metallic layer of high thermal conductivity and high electrical resistivity is alumina, and said metal sheet comprises aluminum.

11. A laundry machine according to claim 1, wherein said heat transfer structure comprises a self-contained module including said motor power control circuitry.

* * * * *